US006132490A

United States Patent [19]

Golub et al.

[11] Patent Number: 6,132,490

[45] Date of Patent: Oct. 17, 2000

[54] BROMIDE SALTS AS WEIGHTENING AGENTS FOR MOLTEN SALTS

[75] Inventors: Gilad Golub; Gennady Katsnelson, both of Beer-Sheva; Menachem Zinn, Arad; Eliyahu Aghion, Beer-Sheva, all of Israel

[73] Assignee: Dead Sea Works Ltd., Beer-Sheva, Israel

[21] Appl. No.: 09/096,098

[22] Filed: Jun. 11, 1998

[30] Foreign Application Priority Data

Dec. 1, 1997 [IL] Israel ..... 122376

[51] Int. Cl.[7] ..... C22B 26/22

[52] U.S. Cl. ..... 75/604; 423/497; 423/499.1

[58] Field of Search ..... 75/600, 604; 420/402, 420/590; 423/491, 497, 499.1

[56] References Cited

U.S. PATENT DOCUMENTS 4,295,884 10/1981 Hichter et al. ..... 75/604
4,385,931 5/1983 Wallevik et al. ..... 75/601
5,167,700 12/1992 Wallevik et al. ..... 75/594

FOREIGN PATENT DOCUMENTS 1022978 12/1978 Canada .
469347 7/1937 United Kingdom ..... 75/604

OTHER PUBLICATIONS

Hawley, G. The Condensed Chemical Dictionary, 8th ed., Van Nostrand Reinhold Company: New York. 1971. pp. 153, 154, 534, 719 and 796.

Lide, D. R. CRC Handbook of Chemistry and Physics, 79th ed., CRC Press: Boca Raton. 1998. pp. 4–47, 4–67, 4–68, 4–77 and 4–85.

*Primary Examiner*—Jill Warden
*Assistant Examiner*—Tima McGuthry-Banks
*Attorney, Agent, or Firm*—Anderson, Kill & Olick P.C.

[57] ABSTRACT

A weightening composition for weightening a molten salt in the refinement of magnesium or magnesium alloys, characterized in that it comprises one or more bromide salts, selected from among NaBr, KBr, $MgBr_2$ or $CaBr_2$.

1 Claim, No Drawings

BROMIDE SALTS AS WEIGHTENING AGENTS FOR MOLTEN SALTS

FIELD OF THE INVENTION

The present invention relates to the field of magnesium refinement through molten salts, using a refining furnace. More particularly, the invention relates to a composition of molten salts, said salts being weightened by the addition of bromides.

The invention further concerns a process for refining magnesium, which utilizes a composition of molten salts comprising one or more combinations of $F^-$, $Br^-$, $Cl^-$, $Ca^{2+}$, $Na^+$, $K^+$ and $Mg^{2+}$, said molten salts being weightened by the addition of a bromide.

BACKGROUND OF THE INVENTION

Refinement of magnesium from molten salts using furnaces is well known in the art.

U.S. Pat. No. 5,167,700 discloses a method and apparatus for refining magnesium, using a melt composition rich in calcium chloride with a content of calcium fluoride.

Electric furnaces for the continuous refining of magnesium are disclosed in Canadian Patent No. 1022978.

U.S. Pat. No. 4,385,931 describes an improved method for the continuous refining of magnesium by the precipitation of impurities in the form of sludge, and a refining furnace for carrying out the method.

Magnesium refining today is mostly carried out from a melt placed in a suitable furnace. After a period of time, the mixture is allowed to stand to let the impurities settle down as a sludge at the bottom of the furnace. The refined magnesium collects in the upper part of the furnace.

Barium chloride, a common additive to molten salts for weightening the same, is toxic, therefore working with it is potentially dangerous and needs to be done with much precaution and under safety systems. When barium chloride is used as an additive to molten salts for refinement, it is necessary to remove sludge and salts from the refining equipment. Removal and treatment of barium-containing waste is also problematic and expensive.

Another additive commonly used in weightening molten salts is calcium chloride. The density of this salt compared to barium chloride is low. Therefore, larger quantities of calcium chloride are needed for equal weightening than barium chloride.

The art therefore has so far failed to provide weightening compositions which overcome the aforesaid drawbacks.

SUMMARY OF THE INVENTION

It has now been found that compositions containing one or more bromides could be used for refining magnesium from a sludge. Unlike barium salts the bromides are not toxic and are friendly to the enviroment. Therefore the present invention also offers a solution to the enviromental problems engaged with refining metals.

It is an object of the invention to provide improved weightening compositions for the refining of magnesium and magnesium alloys.

It is another object of the invention to provide an improved process for the refining of magnesium and magnesium alloys.

It is a further object of the present invention is to provide a composition containing one or more bromide salt(s), suitable to be added to a mixture containing magnesium. The free magnesium is then collected at the upper part of the furnace. The additive composition causing the impurities to be separated is required in smaller amounts.

The invention is therefore directed to a weightening composition for weightening a molten salt in the refinement of magnesium or magnesium alloys, characterized in that it comprises one or more bromide salts, selected from among NaBr, KBr, $MgBr_2$ or $CaBr_2$.

The invention is further directed to a process for refining magnesium or magnesium alloys, comprising adding to a molten mass containing molten magnesium, a weightening bromide salt, selected from among NaBr, KBr, $MgBr_2$ and $CaBr_2$.

Other objects and advantages of the invention will become apparent as the description proceeds.

DETAILED DESCRIPTION OF PREFERRED EMBODIMENTS

The bromide salts of magnesium, sodium, potassium and calcium, each salt alone, or a combination thereof, are, according to the present invention used in weightening molten salt mixtures in the refinement of magnesium.

It has been found that the amount of the salt used for that purpose is variable. Any concentration in the range of 2%–98% is suitable for weightening a molten salt mixture for the separation of magnesium from a salt mixture in a suitable refining apparatus.

It has further been found that the bromide salts, according to the present invention, can be used as weightening agents and therefore can be added to any molten salt mixture. If oxygen is present, temperatures of up to 800° C. are usually employed, and in the absense of oxygen higher temperatures can be used.

Table I shows the effect of addition of sodium bromide on the density and melting point of molten salts in the refinement of magnesium in a refining equipment. The molten salt composition is as in Example 1. In the absence of any weightening agent, the molten salt melted at 725° C. has a density of 1.56 g/cm$^3$. When the mixture melting point is 750° C., the density is only 1.52 g/cm$^3$. Upon addition of sodium bromide to the refining mixture, there is a slight decrease in the melting point of the mixture and an increase in its density. The density increases from 1.60 g/cm$^3$ for 10% NaBr to 1.69 g/cm$^3$ when 25% NaBr is used.

TABLE I

| Additive | Concentration (%) | Working Temperature (° C.) | Density (g/cm$^3$) |
|---|---|---|---|
| — | — | 725 | 1.56 |
| — | — | 750 | 1.52 |
| NaBr | 10 | 730 | 1.60 |
| NaBr | 25 | 740 | 1.69 |
| NaBr | 15 | 705 | 1.69 |
| NaBr | 25 | 705 | 1.71 |
| $BaCl_2$ | 10 | 740 | 1.63 |
| $BaCl_2$ | 16 | 740 | 1.67 |
| $BaCl_2$ | 5 | 705 | 1.60 |
| $BaCl_2$ | 10 | 705 | 1.65 |
| $BaCl_2$ | 15 | 705 | 1.71 |

For the purpose of comparison, the densities and working temperatures of molten salt mixtures containing barium chloride as a weightening agent are also shown in Table I. It can be seen that a mixture containing 25% sodium bromide is equivalent in density to a 15% barium chloride.

The use of bromide salts according to the present invention as weightening agents in molten salts is accomplished by the addition of said salts to molten mixtures. The weightened molten salt prepared in such a way is utilized in the refinement of melted magnesium and its alloys from non-metallic substances (salts and oxides) originating from the electrolyte from which they were prepared, and also from the oxidation products of the electrolyte and the metal. The weightened molten salt adsorbs the non-metallic substances and precipitates them.

The difference between the density of magnesium or its alloys and that of the weightened melt permits the separation of two phase, the metallic phase comprising the separated magnesium or its alloys and the non-metallic phase which consists of the salts and the sludge. The bigger the difference between the densities, the faster the separation is performed.

Table II lists some advantages of bromides as weightening additives over prior art chlorides. The melting point of sodium bromide is lower than that of calcium chloride and much lower than that of barium chloride. The melting point of the hydrates of sodium bromide is lower than the melting point of barium chloride hydrate, and it is at the same order of magnitude of that of calcium chloride.

As to the density, Table II shows the advantages of the bromides over the other salts. These properties, together with very low toxidity and very low tendency to hydrolysis and low hygroscopic properties of sodium bromide, as a representative of other bromides of the present invention, illustrate the superiority of bromides as novel weightening agents over weightening agents used in the art.

TABLE II

| Property/substance | NaBr | $BaCl_2$ | $CaCl_2$ |
|---|---|---|---|
| Melting Point. (Pure Subs.) | 747° C. | 962° C. | 782° C. |
| Melting Point. (Hydrate) | 51° C. | 113° C. | 30° C. |

TABLE II-continued

| Property/substance | NaBr | $BaCl_2$ | $CaCl_2$ |
|---|---|---|---|
| Density (25° C.) | 3.203 | 3.856 | 2.15 |
| Hygroscopic | low | medium | high |
| Hydrolysis | very low | medium | high |
| Toxidity | very low | very high | very low |

EXAMPLE 1

A molten salt combination consisting of 11% $MgCl_2$, 68% KCl, 18% NaCl, 1% $CaCl_2$, 0.8% MgO, 1% $CaF_2$, weighing 3.6 Kg, and 0.4 Kg sodium bromide as a weightening agent were added to a crucible and the temperature was brought up to 750° C. 8 Kg of crude magnesium was added to the mixture, said mixture was then melted while the temperature was maintained at 720° C.

The mixture in the crucible was agitated for 10 minutes, after which the mixture was allowed to settle down for 40 minutes. A sample was taken for the analysis of magnesium, which showed an excellent magnesium quality.

All the above description and examples have been given for the purpose of illustration and are not intended to limit the invention in any way. Many modifications can be carried out in the weightening compositions and processes, without exceeding the scope of the invention.

What is claimed is:

1. In a process for refining magnesium or magnesium alloy by contacting the magnesium or magnesium alloy with a molten salt mixture, the improvement which comprises adding a weightening agent to the molten salt mixture, wherein the weightening agent is a salt selected from the group consisting of NaBr, KBr, $MgBr_2$ and $CaBr_2$.

* * * * *